US011015801B2

(12) United States Patent
Miller et al.

(10) Patent No.: US 11,015,801 B2
(45) Date of Patent: May 25, 2021

(54) BOILER AND MODIFYING METHOD THEREOF

(71) Applicant: GENERAL ELECTRIC COMPANY, Schenectady, NY (US)

(72) Inventors: William Ross Miller, Aargau (CH); Xiangmei Yin, Beijing (CN); Gerhard Weissinger, Stuttgart (DE); Hellmuth Brueggemann, Stuttgart (DE); Danny Edward Gelbar, Windsor, CT (US); Frank Michael Kluger, Stuttgart (DE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/969,890

(22) Filed: May 3, 2018

(65) Prior Publication Data

US 2018/0328583 A1 Nov. 15, 2018

(30) Foreign Application Priority Data

May 15, 2017 (CN) ..... 201710338144.1

(51) Int. Cl.

| | |
|---|---|
| ***F22G 7/14*** | (2006.01) |
| ***F01K 3/20*** | (2006.01) |
| ***F22G 1/06*** | (2006.01) |
| ***F22G 1/02*** | (2006.01) |

(52) U.S. Cl.

CPC ..... *F22G 7/14* (2013.01); *F01K 3/20* (2013.01); *F22G 1/06* (2013.01); *F22G 1/02* (2013.01)

(58) Field of Classification Search

CPC ..... F22G 7/14; F22G 1/06; F22G 1/02; F01K 3/20

USPC ..... 60/670–681

See application file for complete search history.

(56) References Cited

U.S. PATENT DOCUMENTS

| | | | | | |
|---|---|---|---|---|---|
| 1,779,706 | A * | 10/1930 | Jacobus | F22G 5/20 | 122/478 |
| 2,403,237 | A * | 7/1946 | Powell | F22G 7/14 | 122/480 |
| 2,579,027 | A * | 12/1951 | Walter | F22G 5/04 | 60/658 |
| 2,834,326 | A * | 5/1958 | Schaap | F22B 21/343 | 122/481 |
| 3,151,601 | A * | 10/1964 | Mumper | F22B 33/00 | 122/479.4 |
| 3,364,904 | A * | 1/1968 | Hutchings | F22B 21/002 | 122/480 |
| 5,605,118 | A * | 2/1997 | Sinn | F22G 5/00 | 122/4 A |

(Continued)

*Primary Examiner* — Hoang M Nguyen

(74) *Attorney, Agent, or Firm* — Grogan, Tuccillo & Vanderleeden, LLP

(57) ABSTRACT

A modification of a power boiler is disclosed, which comprises water walls enclosing the furnace for heating water and producing steam; a superheater system provided above the furnace for superheating steam; an additional superheater mounted in the furnace for further superheating steam from the superheater system. A modifying method of a power boiler is also disclosed, which comprises steps of mounting an additional superheater on water walls in a furnace; connecting an output of a superheater system to an inlet of the additional superheater; and connecting an outlet of the additional superheater to a turbine for producing power at an improved plant heat rate.

10 Claims, 5 Drawing Sheets

(56) References Cited

U.S. PATENT DOCUMENTS

| | | | | |
|---|---|---|---|---|
| 8,277,726 | B2 * | 10/2012 | Kung | F01K 21/06 122/459 |
| 2017/0284656 | A1 * | 10/2017 | Wells | F22B 21/34 |

* cited by examiner

BOILER AND MODIFYING METHOD THEREOF

BACKGROUND

This disclosure relates generally to a power boiler for generating steam power, and more particularly to a power boiler and a modifying method of a traditional power boiler.

The theory of a power boiler is to exchange the heat from the fuel, such as coal, to water and then steam with high temperature and high pressure to drive a turbine to generate power. A traditional structural of a power boiler comprises an economizer, a water wall, a drum, a superheater system comprising a starting superheater, an intermediate-superheater and a finishing superheater. The economizer can heat water with flue gas. The water wall can heat water and change the phase to steam by enclosing the furnace. Because the water is at a lower temperature inside the water walls to absorb heat, the material of the water wall can resist exposure to the heat flux of the furnace despite high flame temperatures and direct radiation. The drum receives a mixture of steam and water from the economizer and water walls, separates the water and steam, and sends the steam into the starting superheater and subsequent superheater sections. After the temperature of the steam is raised, the high temperature and high pressure steam is sent to the high-pressure cylinder of the steam turbine through the finishing superheater to generate steam power. A reheater is to receive the steam from the high-pressure cylinder exhaust and reheats the steam to a higher temperature, and sends the re-heated steam to an intermediate pressure cylinder of the turbine to generate power. In this manner, the overall plant heat rate (efficiency) is set.

Traditionally in prior art this increase may be done by removing, redesigning and replacing large portions of the existing superheater system with enlarged heat transfer surfaces. In this embodiment, an alternative method is provided that excludes the need for large work on the existing superheater.

BRIEF DESCRIPTION

In an embodiment, the present disclosure provides a boiler 15, which comprises water walls 11 enclosing a furnace 10 for heating water and producing steam; a superheater system 13 provided above the furnace 10 comprising at least one first superheater for superheating steam; an additional superheater 12 located in the furnace 10 for superheating steam.

In another embodiment, the present disclosure provides a modifying method of a boiler comprising a superheater system with at least one first superheater above a furnace, which comprises steps of mounting an additional superheater 12 on a water wall 11 in the furnace 10; connecting an output of the superheater system 13 to an inlet of the additional superheater 12; and connecting an outlet of the additional superheater 12 to a turbine for producing power at an improved plant heat rate.

In another embodiment, the present disclosure provides an additional superheater 12 for mounting on a water wall 11 of a boiler 15, which comprises a plurality of passages 121 arranged side by side each having a first end and a second end; an inlet header 122 connected with the first end of the passages; and an outlet header 123 connected with the second end of the passages.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Embodiments of the present disclosure will be described herein below with reference to the accompanying drawings. In the following description, well-known functions or constructions are not described in detail to avoid obscuring the disclosure in unnecessary detail.

Unless defined otherwise, technical and scientific terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The terms such as "front," "back," "bottom," and/or "top," unless otherwise noted, are merely used for convenience of description, and are not limited to any one position or spatial orientation. The term "or" is meant to be inclusive and mean either or all the listed items. The use of "including," "comprising," or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect.

Figure 1A:
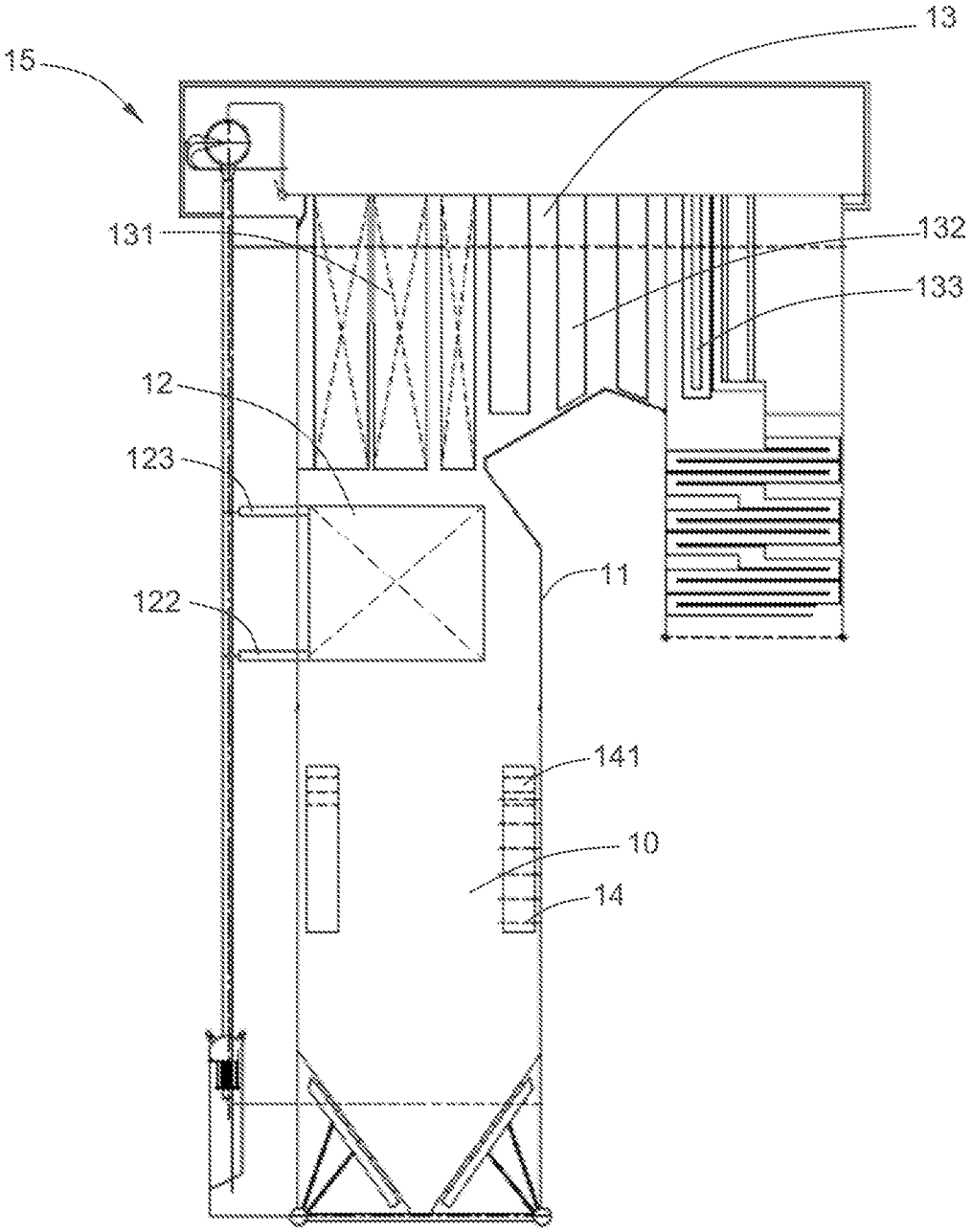
FIG. 1A is an illustrative view of a power boiler, in accordance with an embodiment of the present disclosure.
Figure 1B:
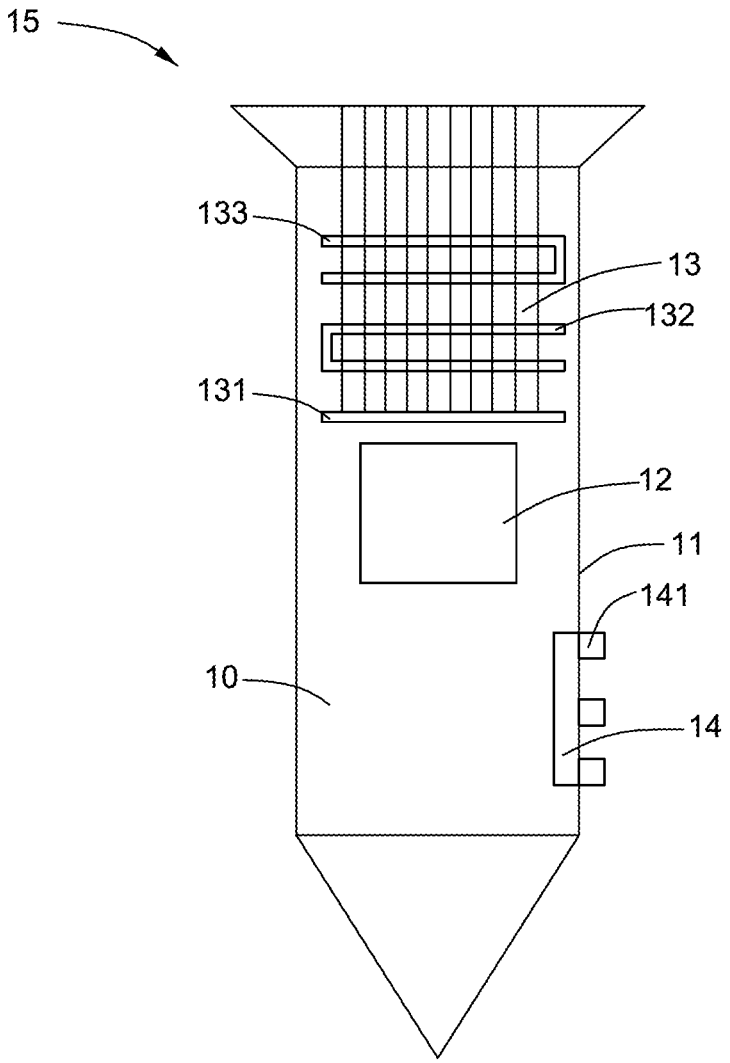
FIG. 1B is an illustrative view of a power boiler, in accordance with another embodiment of the present disclosure.

Referring to FIG. 1A and FIG. 1B of the drawings, the present disclosure provides a power boiler 15 for connecting to a turbine to generate power. The power boiler comprises water walls 11 arranged forming a furnace for heating water and producing steam; a superheater system 13 comprising a first supeheater 131 provided above the furnace for superheating steam; an additional superheater 12 located in the furnace, and mounted on the water walls for further super heating steam; and burners 14 provided on a lower portion of the furnace for providing heat to the water wall 11, the superheater system 13 and the additional superheater 12. The disclosure also applies to any existing arrangement and is not limited to the embodiments as shown in FIG. 1A and FIG. 1B.

Figure 3:
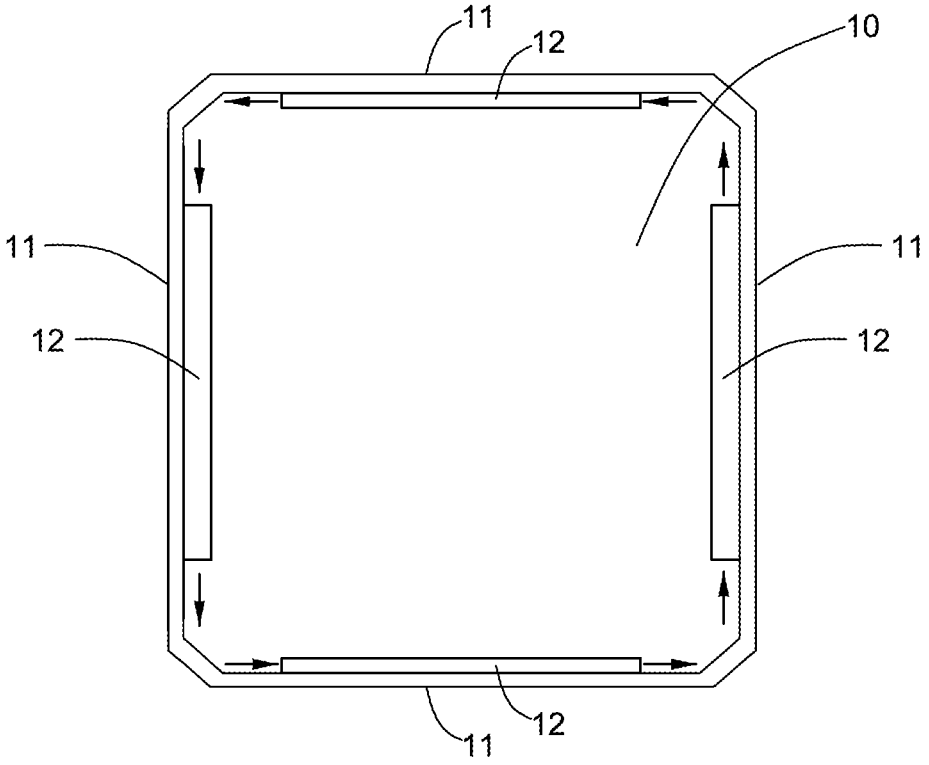
FIG. 3 is a sectional plan view of an additional superheater a boiler, in accordance with an embodiment of the present disclosure.

The furnace 10 is fired by burners 14 with fuel nozzles 141 for injecting fuel to produce flame at the burner zone of the furnace. Referring to FIG. 3 of the drawings, the boiler 15 comprises a plurality of water walls 11, such as four water walls. The water wall 11 is made of tubes with water inside in addition to providing steam generation also provides a heat sink, so that the material of the water wall can resist this very high heat flux from the gas temperature and radiation from combustion, which can be more than 1500° C. The superheater 131 is provided above the furnace and the first superheater 131 comprises a plurality of spaced individual tubes that transfer heat via convective and radiant means, to heat the steam to a higher temperature and pressure, and then to drive the turbine to generate power.

The additional superheater 12 is formed a radiant panel located in the upper portion of the furnace 10 of the present disclosure and is provided to mount on an existing or new water wall to further superheat steam. Due to the direct radiation and high gas temperature (high heat flow or flux) in this area and instead of water described for the water walls 11, the additional superheater 12 already contains high temperature superheated steam, the material of the additional superheater 12 needs to resist a higher metal temperature. In one example, the material of the additional superheater 12 is HR6W. By providing the additional superheater 12 to absorb more heat from the heat source, the heat rate (efficiency) of the plant cycle is improved without altering the existing structure of the boiler or superheater arrangement.

In one embodiment, the additional superheater 12 is connected to the superheater system 13 for further superheating of the steam from the superheater system 13. The temperature of the steam from the existing superheater system 13 is typically about 540° C. and sent to the high-pressure cylinder of a turbine to generate power. However, in this embodiment of the present disclosure, the steam from the existing superheater system 13 is further heated in the additional superheater 12, the temperature of the steam can be raised above the existing superheat temperature, to higher levels such as 540° C. to 650° C., preferably 575° C. to 625° C. Then the heated steam from the additional superheater 12 is sent to the high-pressure cylinder of the turbine for generating power. Due to the higher temperature of the steam, the plant heat rate will improve. Due to the high heat flux in the region of the additional superheater 12, it can be compact and requires less or no modification to the existing superheater system 13.

Figure 2:
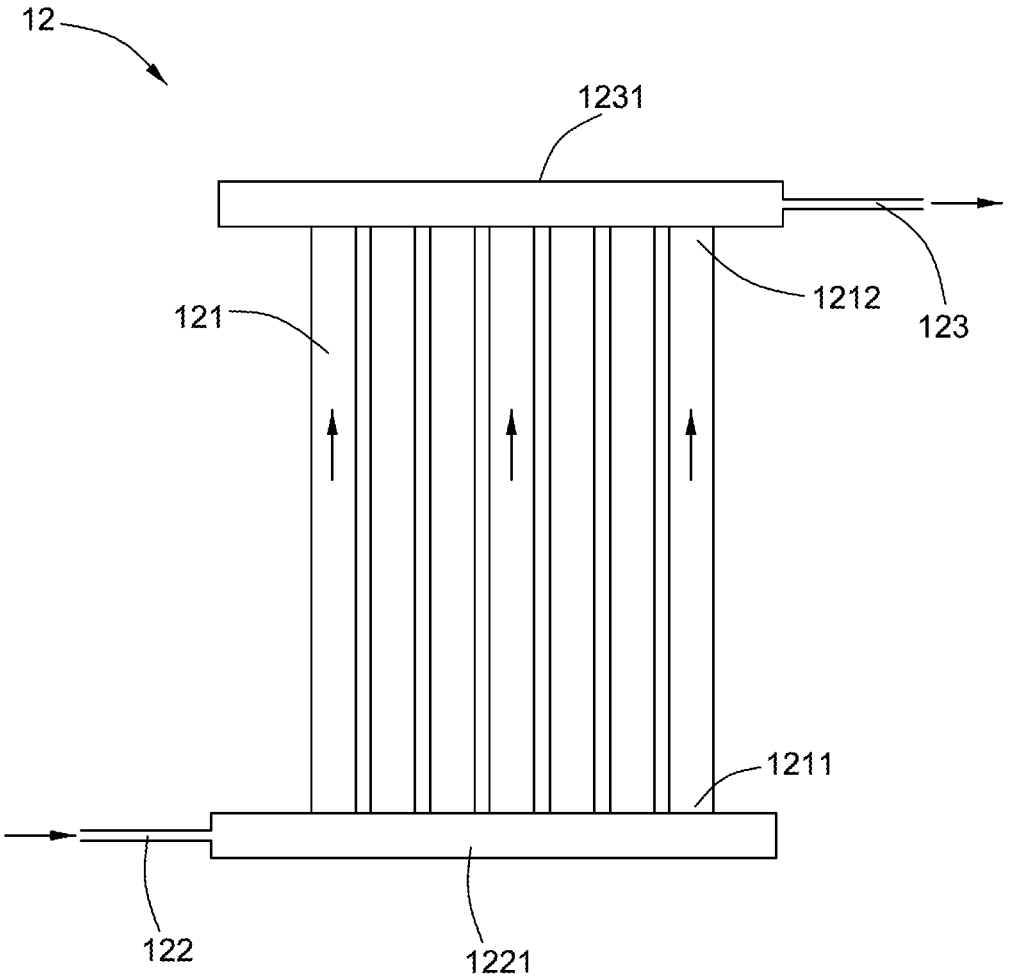
FIG. 2 is a sectional side view of an additional superheater a boiler, in accordance with an embodiment of the present disclosure.

Referring to FIG. 2 of the drawings, in one embodiment, the additional superheater 12 comprises at least one passage 121 having a first end 1211 and a second end 1212; an inlet header 1221 connected with the first end 1211 of the passage for receiving the steam; and an outlet header 1231 connected with the second end 1212 of the passage for output of the steam. The passage is arranged vertically with first end at bottom and second end at top. In one example, the additional superheater 12 comprises a plurality of tubes defining a plurality of passages 121 thereinside. The plurality of passages is arranged side by side.

In one embodiment, the boiler 15 comprises a first connecting pipe 123 to connect the outlet heater 1231 and the turbine and a second connecting pipe 122 to connect the inlet header 1221 and the superheater system 13.

Referring to FIG. 3 of the drawings, in one embodiment, the furnace 10 is enclosed by four water walls 11, and the boiler 15 comprises four additional superheaters 12 mounted on four water walls respectively. The second connecting pipe 122 are connected to the four inlet headers 1221 for inputting the steam from the superheating system 13 to the additional superheater 12, and the four outlet heaters 1231 is connected to the first connecting pipe 123 for outputting the steam from all additional superheaters 12 to the turbine to generate power.

The superheater system 13 comprises a first superheater 131, which is existing superheater, for receiving steam from the drum. The superheater system 13 comprises a finishing heater 133 connected with the first superheater 131 for outputting the steam. The steam from the finishing heater 133 is usually sent to the high-pressure cylinder of the turbine to generate power. However, in one embodiment of this disclosure, the steam from the finishing heater 133 is sent to the additional superheater 12 through the second connecting pipe 122 and inlet header 1221 to be further heated, and then sent to the high-pressure cylinder of the turbine to generate power through the outlet header 1231 and first connecting pipe 123.

The superheater system 13 further comprises a reheater 132 connected with the turbine to reheat the steam exhausted from the high-pressure cylinder of the turbine. Then the reheated steam is sent to an intermediate cylinder of the turbine to generate power.

In other embodiments, the additional superheater 12 can be connected into any part of the steam flow to increase the temperature of the steam, such as between the first superheater 131 and the finishing superheater 133, or before or after the reheater 132 to further heat the reheated steam, which can all improve the overall heat rate of the plant.

Figure 4:
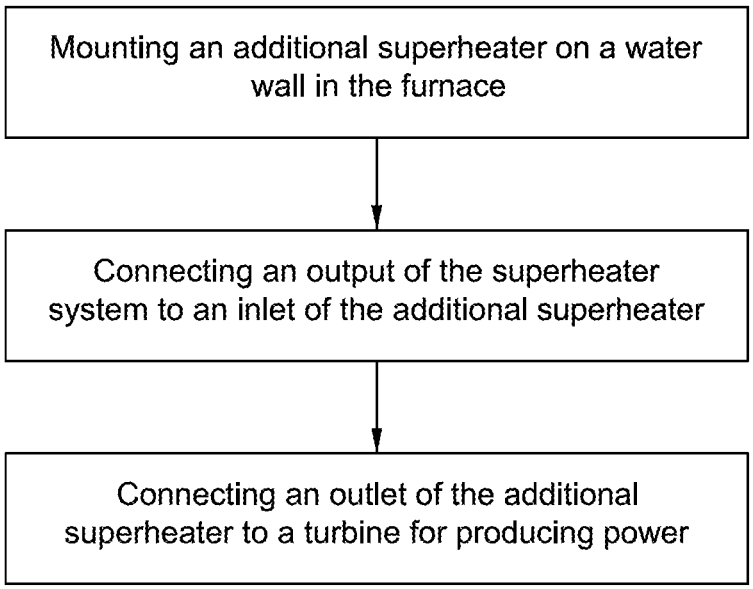
FIG. 4 is a flow chart of a modifying method of a boiler, in accordance with an embodiment of the present disclosure.

Referring to FIG. 1 and FIG. 4 of the drawings, the present disclosure also provides a modifying method of a power boiler 15 comprising a superheater system 13 with a first superheater 131 above a furnace 10, comprising steps of mounting an additional superheater 12 on a water wall 11 in the furnace 10; connecting an output of the superheater system 13 to an inlet of the additional superheater 12; and connecting an outlet of the additional superheater 12 to a turbine for producing power.

In one embodiment, the additional superheater 12 comprises a material capable of resisting the high furnace heat flux present in the furnace while further superheating steam above an output temperature of the superheater system. In one example the material of the additional superheater 12 can resist a temperature of at least 600° C., or over a temperature of 700° C.

Referring to FIG. 2 and FIG. 3 of the drawings, connecting an output of the superheater system 13 to an inlet of the additional superheater 12 comprises connecting an output of a superheater system 13 to an inlet header 1221 of the additional superheater 12 through the second connecting pipe 122. Connecting an outlet of the additional superheater 12 to a turbine comprise connecting an outlet header 1231 of the additional superheater 12 to a turbine through the first connecting pipe 123.

While the disclosure has been illustrated, and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A boiler, comprising:

an existing furnace having a waterwall portion for heating water and producing steam and an above the waterwall portion for housing at least a superheater system;

a superheater system provided at least partially in the above the waterwall portion comprising a first superheater formed of a plurality of individually spaced tubes, for the superheating steam subjected to a first heat flux;

an additional superheater formed of a radiant panel added to the existing furnace located within and attached to the waterwall portion of the furnace subjected to a higher heat flux for superheating steam; and wherein the additional superheater is connected to the superheater system for superheating the steam from the superheater system and the heat flux exhibits a maximum temperature of about 540° C., and the higher furnace heat flux exhibits a temperature of about 600° C.

2. The boiler of claim 1, wherein the additional superheater is mounted on the water walls in the furnace.

3. The boiler of claim 2, wherein the additional superheater comprises at least one passage having a first end and a second end, and is arranged with the first end at bottom and the second end at top.

4. The boiler of claim 3, wherein the additional superheater comprises an inlet header connected with the first end of the passage; and an outlet header connected with the second end of the passage.

5. The boiler of claim 4, comprising a first connecting pipe connecting with the outlet header and a second connecting pipe connecting the superheater system and the inlet header.

6. The boiler of claim 1, comprising a plurality of additional superheaters mounted on the water walls.

7. The boiler of claim 1, wherein the additional superheater comprises a material capable of resisting the high furnace heat flux present in the furnace while further superheating steam above an output temperature of the superheater system.

8. A modifying method of an existing boiler having a water wall portion and an above the water wall portion, the boiler comprising a superheater system with at least one first superheater at least partially directly in the above the waterwall portion of the boiler and subjected to a first temperature heat flux, the method comprising:

mounting an additional superheater added to the existing boiler on the waterwall portion subjected to higher temperature heat flux, in the boiler having a furnace, wherein the additional superheater is at least one of a different construction and a different material than the first superheater of the superheater system;

connecting an output of the superheater system to an inlet of the additional superheater; and connecting an outlet of the additional superheater to a turbine for producing power.

9. An additional superheater for mounting on a water wall of an existing boiler subjected to a high heat flux, comprising:

a plurality of passages arranged side by side having a first end and a second end formed as a radiant panel;

an inlet header connected with the first end of the passages, the inlet header configured to receive superheated steam from an existing superheater system mounted at least partially in an above the waterwall portion of the boiler, the superheater system comprising a superheater formed of a plurality of individually spaced tubes for superheating steam subjected to a heat flux, wherein the additional superheater is located in the furnace to receive higher furnace heat flux than the superheater system; and an outlet header connected with the second end of the passages;

wherein the heat flux exhibits a maximum temperature of about 540° C., and the higher furnace heat flux exhibits a temperature of about 600° C.

10. The boiler of claim 1, wherein the additional superheater is formed of HR6W alloy material.

* * * * *